United States Patent [19]

Lochet

[11] Patent Number: 4,795,534

[45] **Date of Patent: * Jan. 3, 1989**

[54] ELECTROLYTE SOLUTION AND PROCESS FOR GOLD ELECTROPLATING

[75] Inventor: Jean A. Lochet, Metuchen, N.J.

[73] Assignee: Vanguard Research Associates, Inc., South Plainfield, N.J.

[ * ] Notice: The portion of the term of this patent subsequent to Jun. 2, 2004 has been disclaimed.

[21] Appl. No.: 57,011

[22] Filed: Jun. 1, 1987

Related U.S. Application Data

[63] Continuation-in-part of Ser. No. 912,171, Sep. 25, 1986, Pat. No. 4,670,107, which is a continuation of Ser. No. 836,240, Mar. 5, 1986, abandoned.

[51] Int. Cl.[4] ..... C25D 3/62

[52] U.S. Cl. ..... 204/44.3

[58] Field of Search ..... 204/44.3

[56] References Cited

U.S. PATENT DOCUMENTS 4,591,415 5/1986 Whitlaw ..... 204/15

4,670,107 6/1987 Lochet ..... 204/44.3

FOREIGN PATENT DOCUMENTS 2413736 10/1974 Fed. Rep. of Germany ..... 204/44.3

*Primary Examiner*—G. L. Kaplan

*Attorney, Agent, or Firm*—Stefan J. Klauber

[57] ABSTRACT

A bath for producing deposits of gold by electrodeposition, comprising: an aqueous solution containing at least one soluble gold cyanide compound; formic acid in a concentration of at least 20 ml/l to about 150 ml/l of said bath solution, said formic acid concentrations being calculated on a 90% by weight grade of formic acid; a cobalt compound; sufficient alkali to bring the pH to within the range of 3.5 to 4.4; and as conductivity salts and inhibitors, malic acid or a combination thereof with gluconic acid or with a water soluble organophosphorus chelating agent, said conductivity salts and inhibitors being present in at least sufficient quantity to provide a specific gravity of at least 13 Baume' in said bath.

13 Claims, No Drawings

ELECTROLYTE SOLUTION AND PROCESS FOR GOLD ELECTROPLATING

RELATED APPLICATION

This application is a continuation-in-part of co-pending application Ser. No. 912,171, filed Sept. 25, 1986, now U.S. Pat. No. 4,670,107, which in turn is a continuation of Ser. No. 836,240, filed March 5, 1986.

FIELD OF THE INVENTION

This invention relates to the electrodeposition of gold from an aqueous soluble gold cyanide plating bath. More particularly, it relates to obtaining bright gold deposits at high temperatures and high plating rates, e.g. without degradation of the quality of the deposit.

BACKGROUND OF THE INVENTION

In U.S. Pat. No. 2,905,601, an electrolytic bath for plating gold or a gold alloy is disclosed which contains a cyanide of gold, a base metal salt such as of cobalt, nickel, indium, etc., and citric acid plus sodium citrate or aceticacid plus sodium acetate. The combination of, e.g. citric acid and its salt is clearly intended to act as a buffer to maintain the bath within a pH range of about 3–5. The use of other weak acids such as lactic, formic, etc., is mentioned, but there is no demonstration of a bath containing formic acid. A current density range of 1–100 ASF (amperes per square foot) with only 10 ASF being demonstrated, and a temperature range of 50° to 120° F. with 70° F. being preferred, are disclosed. U.S. Pat. No. 3,104,212 differs from the above in that the base metal salt is omitted.

U.S. Pat. No. 3,672,969 discloses a gold plating bath which contains an organophosphorus chelating compound, typically a phosphorus acid, e.g. amino-tri (methylphosphonic acid) or 1-hydroxyethylidene-1,1-diphosphonic acid. As an improvement, a water soluble citrate is included in the bath. However, there is no mention of formic acid.

The production of gold-copper-antimony alloys is discussed in U.S. Pat. Nos. 3,380,814 and 3,380,898. A complexing agent such as ethylenediaminetetraacetic acid (EDTA) is employed in the bath and a weak acid and salt thereof to provide a pH of 4.5 to 6.0, exemplified $KH_2PO_4$ (a partially neutralized acid salt), partially neutralized citric acid, tartaric acid or acetic acid.

The use of nickel or cobalt chelates as brightener/-hardeners is taught in U.S. Pat. Nos. 3,149,057 and '058. The use of aliphatic acids of 2 to 8 carbon atoms such as acetic, citric, tartaric, etc., when properly neutralized to act as buffers to maintain a pH between 3 and 5, is described. U.S. Pat. No. 4,186,064, discloses phosphate salts and citric acid salts as the conducting and buffering agents, and cobalt or nickel chelates of an organophosphorus compound such as nitrilotri (methylene phosphonic acid).

U.S. Pat. No. 4,253,920 discloses a gold plating bath which includes potassium dihydrogen phosphate, a Cu or Ni hardener/brightener and, as chelating agent, 1-hydroxyethylidene-1, 1-diphosphonic acid. No weak organic acids are present. In U.S. Pat. No. 4,197,172, the chelating agent is nitrilotris (methylene) triphosphonic acid (sold as Dequest 2000). U.S. Pat. No. 4,396,471 states that virtually any conductive acid or salt may be used as electrolyte and the composition of the electrolyte is not critical, mentioning weak organic acids such as malic, formic, and especially citric. Potassium citrate plus citric acid to buffer the bath, is recommended.

Commercially, parts to be plated can be plated on a continuous basis on reel-to-reel selective plating machines, see "Continuous Reel-to-Reel Plating for the Electronics Industry" by Jean Lochet et al, an AES Electronics Lecture. Such machines are very expensive and perform all the plating steps on a continuous basis, including cleaning, activation, undercoating, and final plating of the parts by processing the parts, in successive steps, through the complete plating cycle. Basically, their processing speed is only limited by the deposition speed, i.e. the ability of the plating baths to produce acceptable deposits of required thicknesses rapidly. It can be seen as a matter of economics that high deposition rates are highly desirable, since the higher the production is, the lower the unit cost becomes.

The introduction of continuous selective high speed plating required gold solutions capable of plating at much higher speed and current densities. At first, when low gold prices prevailed, this was met simply by increasing the gold concentration of the bath, because as a general rule higher gold concentrations permit higher efficiency, current densities and plating rates. That is, in the typical gold bath of U.S. Pat. No. 2,905,601 with 8 grams per liter of gold, this was increased to 32 grams per liter and even higher to obtain higher current density and plating speed. However, with the advent of greatly increased gold prices, this became impractical. For economic reasons (lower inventory, lower drag out, etc.) gold contents should be kept as low as possible. Consequently, other routes were sought to obtaining high speed gold plating baths with lower gold concentrations and high acceptable current densities.

Formulations were proposed making use of so-called current extenders. Typically, such current extenders increase the bath's ability to plate at high current densities without the deposit being burnt. A burnt deposit is spongy and black. It will be understood that higher current densities mean higher rates of deposition, since theoretically one ampere will deposit a definite amount of metal in one second.

As illustrative, in U.S. Pat. No. 3,929,595, the current extender is a heterocylic azohydrocarbon sulfonic acid or salt thereof. In U.S. Pat. No. 4,436,595, glycolic acid with a salt thereof is used as current extender. However, the addition of heterocyclic azohydrocarbon sulfonic acids or salts thereof or of glycolic acid and its salts, to gold plating solutions, reduces significantly the current efficiency, expressed as mg/ ampere-minute, to very small values, rendering the buildup of the thick bright deposits difficult or impossible in high speed applications in which thick deposits have to be built up in a very short time, termed "retention time". That is, the low current efficiency works oppositely to the effect of high current density. The low efficiency of these baths at high current densities could be overcome by increasing the temperature from the usual maximum range of 120°–130° F. to 150° F. However, when that is done, the resulting deposits become dull or even burnt, hence unacceptable. Thus, such current extenders, although improvements for certain applications, are of limited interest or impractical for some high speed applications. As stated in U.S. Pat. No. 4,436,595 at column 3, lines 25–29, the lower the temperature, the brighter the deposit, but the slower the plating speed, and vice versa; and as a compromise between brightness and plating speed, an operating temperature of 130° F. is preferred.

In fact, in practice, very few if any known acid gold plating baths give bright deposits at 150° F., whereas, as will be seen in the ensuing description, the reverse is true for the baths of the present invention.

Furthermore, in many instances, the deposits produced by some high speed electrolytes still fall short of expectation for the following reasons:

High current density plating in the order of 500 to 1000 ASF at the cathode results in similar, and in some cases because of very small anode areas, in even higher anodic current densities. Such high anodic current densities are highly undesirable because of anodic oxidation phenomena.

In most cases, the cobalt and/or nickel brighteners/-hardeners usually present in the valency of 2 are oxidized to the higher valency of 3 and/or even changed to the highly undesirable inactive potassium cobalticyanide $K_3[Co(CN)_6]$ or similar hydroxy complexes of the same family. The gold is also, in some cases, partially or even fully oxidized to the higher valency of 3, hence considerably reducing the efficiency and the rate of plating. Also, oxygen is often absorbed by the electrolyte and decreases efficiency and worsens metal distribution, as discussed in U.S. Pat. No. 3,669,852 recommending several methods to remove oxygen from gold plating baths.

In U.S. Pat. No. 3,475,290 an alkyl or alkylene quanidine compound is used in the bath and a large quantity of reducing agent such as formic acid is used to prevent its decomposition.

U.S. Pat. No. 3,904,493 discloses gold sulfite plating baths containing organophosphorus compounds such as phosphonic acids. A brightening agent such as nickel may be included in the baths. The addition of mineral or organic acids, bases or buffers to control pH, within a range of 5 to 11, is mentioned but the choice is not critical. Current densities useful for the baths are rather limited, e.g., of the order of about 1 A/dm$^2$.

Other disclosures of general interest in this area are:

U.S. Pat. No. 3,893,896;

U.S. Pat. No. 4,075,065;

U.S. Pat. No. 4,076,598;

U.K. patent application No. 2,039,532A;

"Selective Plating Equipment—What Are the Options?," by Douglas R. Stewart, AES Symposium on Economic Use of and Substitution for Precious Metals in the Electronics Industry, Sept. 16–17, 1980; "Multi-Lateral Thicknesses in Individually Plated Stripes", by Brian C. Dowling, Second AES Symposium, Oct. 5–6, 1982; "Super Selective Reel to Reel Plating", by Peter Meuldijk, Second AES Symposium, Oct. 5–6, 1982; and Products Finishing, pp. 21–22, 24–25, January, 1941.

SUMMARY OF THE INVENTION

It has now been found that in the electroplating of gold from an aqueous bath containing a soluble gold cyanide, e.g. an alkali metal gold cyanide, formic acid in a critical concentration and an organophosphorus chelating agent, in particular a phosphonic acid, act in a synergistic manner to allow high plating speeds. The preferred phosphonic acids are 1-hydroxyethylidene-1, 1-diphosphonic acid, sold under the tradename of Dequest 2010 and aminotri(methylene phosphonic acid) sold under the trade name Dequest 2000, both available from the Monsanto Company. It is believed that in this composition the formic acid acts as a current extender, permitting high current densities and also high temperatures to be used thereby achieving high plating speeds.

For convenience, the amounts of formic acid are given in milliliters. The formic acid should be present in an amount of at least 20 ml/liter to about 150 ml/liter, preferably above 40 ml/liter to about 90 ml /liter, more preferably above 40 ml/liter to about 50 ml/liter, based on the standard purified or C.P. grade containing approximately 90 weight % of formic acid. Concentration of the organophosphorus compound in the range of 50–150 ml/l have given good results. The electrolyte or conductivity salt may, in some cases, be a mixture of an alkali metal monophosphate and a phosphonic acid or mixed phosphonic acids.

Cobalt or nickel which may be introduced as their salts or chelates, e.g. as the sulfate, may be used as brightener/hardeners. The cobalt or nickel concentration may be in the range of 350 to 600 mg/liter, preferably about 500 mg/liter.

The pH is also critical and it has been found that when cobalt is present the pH should be in the range of 4.0 to 4.2, and that when nickel is present the pH should be in the range of 3.8 to 3.9.

The gold concentration may range up to 30 g/liter, preferably may be in the range of 8 to 20 g/liter, e.g. 10 to 20 g/liter, but for some plating techniques may be lower, e.g. from 2 to 4 g/liter.

As will be seen in the following description, the addition of formic acid and a chelating organophosphorus compound to the bath gives unexpected results, i.e., produces bright gold deposits at high deposition speed.

The plating may be accomplished by any of the commercial means available such as barrel, rack and strip plating equipment and high speed continuos selective plating equipment. The products are useful for industrial purposes, especially for making electrical connections, e.g. as connectors. Depending on the type of equipment used, plating may be carried out at temperatures in the range of 90° to 160° F. and at current densitites from about 0.5 to an excess of 1000 ASF. The process yields deposits having a cobalt or nickel content of 0.15 to 0.2% and a hardness in the range of 130–200 Knoop.

DETAILED DESCRIPTION

The invention will be descrbed with reference to the ensuing tests and Examples, which are intended to be illustrated but not limitative.

Extensive testing was carried out in order to provide a stable solution capable of plating at a higher rate and higher current densities than the currently commercially available solutions, without the problems discussed above.

The formic acid used throughout the testing was the standard purified or C.P. grade containing approximately 90 weight percent of formic acid. The weight of 1 liter (or 1000 ml) of this grade is 1248 grams (or 1 ml=1.248 grams). Since 90% of the weight is formic acid, it follows that 1 ml. contains 1.1232 grams of formic acid. Other amounts can readily be calculated, e.g., 100 ml. contains 112.32 grams of formic acid; 50 ml contains 56.16 grams formic acid, etc. Other grades of formic acid can also be used and in such case equivalent amounts to those disclosed herein can be calculated, for example, at half the concentration of the C.P. grade, twice the number of milliliters of formic acid would be used.

The formula used in these tests for cobalt hardened gold is given by Formula A below unless otherwise indicated.

| FORMULA A | 1 liter |
|---|---|
| Potassium Monophosphate | 70 g |
| Dequest 2010 | 50 ml |
| Formic Acid | 50 ml |
| Potassium hydroxide | to pH 4.0 |
| Cobalt-metal (as sulfate) | 500 mg |
| Au-metal (as PGC) | 20 g |

PGC is an abbreviation for 68% potassium gold cyanide. The cobalt may be any suitable soluble compound such as the sulfate or the complex of a suitable, compatible chelating compound or that of the organophosphorus compounds used in the formula.

The testing method used basically employs a 1 liter beaker with platinum coated anodes, a thermostatically controlled heater, a means to provide mild agitation and a suitable rectifier in which are plated copper wires of about 1 mm in diameter and 320 mm in length turned around a wood cylinder of 2 mm in diameter. These have the advantage over panels of giving a better idea of the bath overall plating abilities. All the wires plated in all the tests have a minimum gold thickness of 50 to 100 microinches.

Test 1
Conditions: Plating Temperature:
150° F. - gold concentration 20 g/l pH 4.0.

| Current Density | 40 ASF | 80 ASF | 120 ASF | 150 ASF |
|---|---|---|---|---|
| Efficiency | 54 mg* | 32 mg | 43 mg | 28 mg |
| Appearance | Sem-bright | bright | bright | bright |

*mg or milligrams per ampere-minute

The bath of test 1, employed in a controlled depth cell such as described in "Continuous Reel-to-Reel Plating for the Electronics Industry" ibid, gave an excellent deposit at 120 ASF.

EXAMPLE I

The same formulation was used in a high agitation cell like the one described in U.S. Pat. No. 4,431,500, with a gold concentration of 15 g/l. An excellent, about 54 microinch thick, bright gold deposit was obtained at a current density of 980 ASF, a temperature of 150° F., and a line speed of 25 feet/minute. The retention time was 3.5 seconds and the efficiency was 39.3 mg per amp. min., which gives a plating speed of 15.48 microinches per second of retention time. It should be noted that a high agitation cell like the one described in U.S. Pat. No. 4,431,500 allows current densitites that are much higher, i.e. 6 to 10 times higher—depending on the cell configuration—than obtained in a beaker (with thin wires), or in a controlled depth cell. For such high agitation, high speed plating, the temperature may suitably be in the range of 100° to 150° F.

TEST 2
Conditions: Plating temperature:
120° F. - gold concentration 20 g/l pH 4.0.

| Current density | 80 ASF | 120 ASF | 150 ASF |
|---|---|---|---|
| Efficiency | 32 mg | 26 mg | 24 mg |
| Appearance | bright | semi-bright | dull |

TEST 3
Condition: Plating temperature:
150° F. but gold concentration increased to 30 g/l:

| Current Density | 40 ASF | 80 ASF | 120 ASF | 150 ASF | 200 ASF | 300 ASF |
|---|---|---|---|---|---|---|
| Efficiency | 53.75 mg | 59.5 mg | 61.8 mg | 62.6 mg | 58.8 mg | 49.1 mg |
| Appearance | dull | bright | bright | bright | bright | hazy |

Such a bath is capable of producing a bright gold deposit at higher current densities, higher temperatures and higher plating rates than that of the prior art.

The above tests show that the deposits' brightness is better at higher temperature (150° F.) than at the lower temperature of 120° F. That is completely unexpected since—as reported in U.S. Pat. No. 4,436,595 at column 3, lines 25–29, as well as in other authoritative technical works—brightness usually decreases as the temperature increases. In practice very few acid gold baths, if any, are bright at 150° F. As mentioned above, the reverse is true for the baths of the present invention, which is totally unexpected.

Further testing shows that another unexpected phenomenon takes place. Tests 4, 5 and 6, set forth below, show that at 150° F., deposit brightness decreases at lower current densities.

TEST 4
Conditions: Plating temperature:
150° F. - gold concentration 20 g/l pH 4.1.

| Current density | 40 ASF | 80 ASF | 120 ASF | 150 ASF | 200 ASF | 250 ASF |
|---|---|---|---|---|---|---|
| Efficiency | 51.75 mg | 57.1 mg | 58.7 mg | 56 mg | 47.3 mg | 42.2 mg |
| Appearance | hazy | bright | bright | bright | hazy | hazy |

However, as shown in Tests 5 and 6, when the gold concentration is reduced to 4 grams or 10 grams per liter, the deposits become brighter at 40 ASF.

TEST 5
Conditions: Plating temperature:
150° F. - gold concentration 4 g/l, pH 4.1.

| Current density | 40 ASF | 80 ASF | 120 ASF | 150 ASF |
|---|---|---|---|---|
| Efficiency | 30.75 mg | 20.3 mg | 15.75 mg | 13.7 mg |
| Appearance | bright | bright | dull | dull |

TEST 6
Conditions: Plating Temperature:
150° F. - gold concentration 10 g/l, pH 4.1.

| Current density | 40 ASF | 80 ASF | 120 ASF | 150 ASF |
|---|---|---|---|---|
| Efficiency | 56.25 mg | 43.6 mg | 38.1 mg | 36.4 mg |
| Appearance | bright | bright | bright | bright |

Thus, when gold concentration is decreased, deposits at lower current densities become brighter. However, other tests show that at 4 g/l, the deposits are not bright at higher current densities in the order of 120 ASF.

When a bath is prepared with formic acid neutralized to pH 4.0 with potassium hydroxide and cobalt is introduced as the sulfate, as soon as the potassium gold cyanide is introduced into the bath, one can observe the immediate formation of an insoluble pinkish—white compound which renders the plating bath unuseable.

However, when the cobalt was introduced in the form of a complex cobalt salt of dequest 2010 (1,1-hydroxyethylidene-1,1-diphosphonic acid) a more stable bath resulted. The formulation used in Test 7 was Formula B below.

| FORMULA B | 1 liter |
|---|---|
| Formic acid | 150 ml |
| Potassium hydroxide | 130 grams |
| Cobalt-metal (as complex) | 500 milligrams |
| Au-metal (as PGC) | 10 grams |
| pH | 4.0 |

TEST 7

Plating temperature: 150° F. The object of the test was to find out the limits of the bath at high current densities. Thus, the current density was increased until burning of the deposit took place.

The results were as shown below:

| Current Densities ASF | Efficiency mg/amp. min. | Appearance |
|---|---|---|
| 40 | 28.9 | Bright |
| 80 | 32.6 | " |
| 120 | 30.8 | " |
| 150 | 30.5 | " |
| 200 | 24.85 | " |
| 300 | 19.9 | " |
| 400 | 16.35 | " |
| 500 | 13.3 | " |
| 600 | 11.2 | Hazy |
| 700 | 10.2 | Burnt |

The above results are somewhat unexpected since the deposits remain bright up to above 500 ASF. However, the color of the deposit was somewhat whiteish, suggesting a high cobalt percentage in the deposits which is considered undesirable in deposits to meet certain specifications.

It appears that an excess amount, i.e., an amount of free chelating agent such as Dequest 2010 (over that contained in a cobalt chelate) is necessary to stabilize the bath and assure the proper concentration of cobalt in the deposit.

A new bath was prepared with an excess of Dequest 2010 in the formulation of the bath used in Test 7 as another attempt to obtain a yellower color. The following concentrations were used, as Formula C below, in Test 8.

| FORMULA C | 1 liter |
|---|---|
| Dequest 2010 | 50 ml |
| Formic acid | 50 ml |
| Potassium hydroxide | 68 grams |
| pH | 4.0 |
| Cobalt (as cobalt sulfate) | 500 mgs. |
| Au (as PGC) | 10 grams |

TEST 8
Plating temperature: 150° F.

| Current Density | 40 ASF | 80 ASF | 120 ASF | 150 ASF | 200 ASF |
|---|---|---|---|---|---|
| Efficiency | 52.9 mg | 45.6 mg | 40.0 mg | 34.4 mg | 30.0 mg |
| Appear- | bright | bright | bright | bright | burnt |

-continued

TEST 8
Plating temperature: 150° F.

ance

Results: Color is now a rich yellow and the cobalt content significantly reduced to within the range of 0.1 to 0.2%, which is perfectly acceptable. The bath gives results similar and comparable to the bath used in Test 1. This demonstrates that a free chelating agent of the organophosphorus type is required to work in cooperation with the formic acid and inhibit the cobalt deposition.

A bath was prepared similar to that used in Test 1, but without excess Dequest 2010, as shown in Formula D below, and was used in Test 9.

| FORMULA D | 1 liter |
|---|---|
| Potassium phosphate monobasic | 70 grams |
| Formic Acid | 50 ml |
| Cobalt (as complex of Dequest 2010) | 500 mgs |
| pH | 4.0 |
| Au (as PGC) | 10 grams |

TEST 9

| Plating Temperature: 150° F. | | | | |
|---|---|---|---|---|
| Current Density | 40 ASF | 80 ASF | 120 ASF | 150 ASF |
| Efficiency | 49.6 mg | 55.6 mg | 43.8 mg | 37.0 mg |
| Appearance | bright | burnt | burnt | burnt |

Results: As the efficiencies obtained with the baths of Tests 1 and 8 are comparable, the aspect of the resulting deposits in Test 9 is far from being as good and is unacceptable at 80 ASF. From the above tests, it is quite clear that a synergistic effect takes place in the baths of tests 1 and 8, which produce superior bright deposits at 150° F. The synergistic effect appears to be primarily between the Dequest 2010 and the formic acid.

A number of tests were run to determine whether the concentration of formic acid is critical. A bath without formic acid but similar to the bath used in Test 1, was prepared. The formulation is given as Formula E below.

| FORMULA E | 1 liter |
|---|---|
| Monopotassium phosphate | 100 grams |
| Dequest 2010 | 50 ml |
| Potassium hydroxide to adjust pH to 4.0 | |
| Cobalt metal | 500 mgs |
| Au—metal (as PGC) | 10 grams |

The thin copper wires of the type used in Test 1 were plated in the above solution and the results are set forth below. The plating temperature was 150° F.

TEST 10

| Current Density | 80 ASF | 120 ASF | 150 ASF |
|---|---|---|---|
| Efficiency | 47.0 mg | 29.0 mg | 25.0 mg |
| Appearance | dull | dull | dull |

In the above tests none of the deposits obtained were bright at 150° F.

To the bath used in Test 10, formic acid was added to obtain an increasing concentration in order to run tests with the following concentrations of formic acid: 5, 10, 20, 30, and 40 ml/liter. For all the tests, the pH was adjusted to 4.0 with KOH, and the gold concentration to 10 g/l. The plating temperature was 150° F. The results are given below:

| Test 11 (5 ml of formic acid): | | | |
|---|---|---|---|
| Current Density | 80 ASF | 120 ASF | 150 ASF |
| Efficiency | 45.0 mg | 30.0 mg | 27.0 mg |
| Appearance | dull | dull | dull |

| Test 12 (10 ml of formic acid): | | | | |
|---|---|---|---|---|
| Current Density | 40 ASF | 80 ASF | 120 ASF | 150 ASF |
| Efficiency | 52 mg | 45.0 mg | 33.0 mg | 27.0 mg |
| Appearance | semi-bright | semi-bright | dull | dull |

| Test 13 (20 ml of formic acid): | | | | |
|---|---|---|---|---|
| Current Density | 40 ASF | 80 ASF | 120 ASF | 150 ASF |
| Efficiency | 54 mg | 45.0 mg | 37.0 mg | 30.0 mg |
| Appearance | semi-bright | semi-bright | semi-bright | dull |

| Test 14 (30 ml of formic acid): | | | | |
|---|---|---|---|---|
| Current Density | 40 ASF | 80 ASF | 120 ASF | 150 ASF |
| Efficiency | 56.5 mg | 45.0 mg | 34.0 mg | 30.0 mg |
| Appearance | semi-bright | semi-bright | semi-bright | dull |

| Test 15 (40 ml of formic acid): | | | | |
|---|---|---|---|---|
| Current Density | 40 ASF | 80 ASF | 120 ASF | 150 ASF |
| Efficiency | | 41.0 mg | 32.0 mg | 27.0 mg |
| Appearance | bright | semi-bright | semi-bright | dull |

Although concentrations as low as 20 ml/l begin to show an improvement at lower current densities, all of the tests 10–15 show that the minimum effective concentration of formic acid to assure acceptable, consistent, high build, bright deposits at 150° F. over 40 ASF is above 40 ml/l. Preferably, the concentration should be about 50 ml/l as shown by Test 1.

To the bath used in Test 10, formic acid was added to obtain a concentration above th elevel considered otpimum of 50 ml per liter. No adverse effect was observed other than a slight decrease in efficiency as can be noted below. The gold concentration was 10 grams per liter and the plating temperature was 150° F.

| Test 16 (Formic acid 75 ml): | | | | |
|---|---|---|---|---|
| Current Density | 40 ASF | 80 ASF | 120 ASF | 150 ASF |
| Efficiency | 54 mg | 43 mg | 37 mg | 30 mg |
| Appearance | dull | bright | bright | bright |

| Test 17 (Formic acid 150 ml): | | | | |
|---|---|---|---|---|
| Current Density | 40 ASF | 80 ASF | 120 ASF | 150 ASF |
| Efficiency | 54 mg | 42 mg | 32 mg | 26 mg |
| Appearance | dull | bright | bright | bright |

Surprisingly, addition of other weak acids does not achieve similar results. For instance, a bath was prepared by replacing formic acid with citric acid, as shown in Formula F below, and was used in Test 16.

| FORMULA F | 1 liter |
|---|---|
| Monopotassium phosphate | 50 grams |
| Dequest 2010 | 50 ml |
| Citric Acid | 50 grams |
| Potassium hydroxide to pH | 4.0 |
| Cobalt-metal | 500 mgs |
| Au—metal (as PGC) | 10 grams |

| TEST 18 | | | |
|---|---|---|---|
| Plating Temperature: 150° F. | | | |
| Current Density | 80 ASF | 120 ASF | 150 ASF |
| Efficiency | 50.0 mg | 36.0 mg | 32.0 mg |
| Appearance | semi-bright | burnt | burnt |

The results obtained are far from being comparable with those of Test 1. Even at 120° F., the deposit was unacceptable at 80 ASF since the deposit on the wire was unevenly bright and burnt in the high current density areas. Increasing or decreasing the concentration of citric acid between 10 to 100 grams per liter did not show any significant change or improvement.

Nickel may be substituted for cobalt in similar formulations, however, the preferred pH for more consistent color is 3.8 to 3.9 instead of 4.0 to 4.1 for cobalt. The formulation used in Test 17 was Formula G below:

| FORMULA G | 1 Liter |
|---|---|
| Dequest 2000 | 150 ml |
| Formic Acid | 50 ml |
| Potassium hydroxide to pH | 3.8 (about 110 grams) |
| Nickel-metal (as sulfate) | 500 mgs |
| Au—metal (as PGC) | 10 grams |

| TEST 19 | | | |
|---|---|---|---|
| Plating Temperature: | 150° F. | | |
| Current Density | 80 ASF | 120 ASF | 150 ASF |
| Efficiency | 37 mg | 29 mg | 24 mg |
| Appearance | bright | bright | semi-bright |

Although the efficiency is significantly less than for the cobalt solution, such formulation has proved to be eminently suitable for high speed applications (in controlled depth cells as well as high agitation cells) in which nickel-hardened gold is a requirement. It should be noted that nickel-hardened gold deposits are specified in some higher temperature applications since nickel-hardened gold does not discolor as readily as cobalt-hardened gold.

The nickel content of the deposits was found to be in the range of 0.2 to 0.3% depending on the conditions of deposition.

Tests have also shown that the addition of alkali phosphates, with the exception of ammonium phosphate, is not desirable, as they have a tendency to render the bath unstable resulting in precipitation of the gold and the nickel in the form of one or more unknown compounds. Furthermore, Dequest 2000 is preferred over Dequest 2010 and Dequest 2041 in the above formulation for nickel.

Other unexpected results occur when the bath used in Test 1 is used in conventional barrel plating or in related equipment like the Vibrobot. ®

For optimum results, the bath of Test 1 was modified in order to optimize distribution of the gold deposit. The cobalt content is suitably kept in range of 350 to 415/mg/liter, preferably at about 380 mg/liter. The following formulation, designated Formula H, was used in Example II with the gold concentration at 4 g/liter.

| FORMULA H | 1 liter |
|---|---|
| Monopotassium Phosphate | 75 grams |
| Dequest 2010 | 50 ml |
| Formic acid | 50 ml |
| Cobalt-metal (as sulfate) | 380 mgs |
| Au—metal (as PGC) | 2 to 4 grams |
| pH | 4.0 |

A plating temperature in the range of 90° to 110° F. was selected mainly because it gave a color identical to that of the high speed formulation of Test 1. Higher temperatures may be used.

As can be expected, increasing the plating temperature increases the efficiency and the plating speed; however, at the relatively low current densities used in this type of plating, it decreases the brightness.

A plating temperature of 100° F. appears to be the best all around compromise for uniform color and efficiency.

It should be noted that the standard barrel gold baths of the prior art are limited by their allowable maximum plating current density. When that current density is reached, the resulting deposit becomes burnt and hence unacceptable. That is not the case with the bath of the present invention. It has been found that it is virtually impossible to burn the deposit in such a bath, in a barrel or related equipment, at voltages below 10. Even such voltages are impractical since the limiting factor, usually, is the voltage that can be handled by the rectifier and the platinum coated anodes, reported to be at not above 6 to 7 volts. Above that voltage, the platinum coating is slowly stripped, which renders the anode unsuitable for plating, so that the anode has to be replaced.

Tests show that the cobalt-hardened gold bath of the present invention does not behave like the standard barrel gold plating bath of the prior art and is a quick building bath.

One of the plating requirements on a typical connector was 55 microinches of deposit. Such connectors are plated in bulk in the Vibrobot ® by loads of several thousand parts having a total area between 60 and 90 square feet. As shown in the following, the load was plated in 33 minutes, whereas the very same part plated with a conventional barrel formulation of the prior art required a plating time of 112 minutes.

EXAMPLE II

At a concentration of 4 g/l of gold, tests show that plating speeds between 1 and 1.75 microinches per minute are achieved in a Vibrobot. The part plated is a small typical connector with an area of 0.183 $in^2$ which requires a minimum thickness of 50 microinches. A mean thickness of 56 microinches is obtained in 33 minutes at an average current density of 1.5 ASF with a standard deviation of less than 2. Details of some runs using the same part are presented below.

All parts were bright, uniform in color (without any color variation from lot to lot in spite of different current densitites) and passed solderability specifications.

It should be noted that the main variable is voltage which was not increased above 11 volts for the reasons discussed above. The area plated varied between 62 and 80 sq. ft.

TABLE

| BASKET DIAM | TOTAL AREA | TOTAL AMPS | VOLTAGE | AVERAGE ASF | AMP. MIN. | THICKNESS MEAN | S.D. | MICRO-INCH/MINUTE | EFFICIENCY (Mg/AMP.MIN.) |
|---|---|---|---|---|---|---|---|---|---|
| 500 mm | 76.6 | 40 | 5.5 | .523 | 4900 | 59.68 | 1.33 | .4871 | 34 |
| 500 mm | 64.6 | 40 | 5.5 | .62 | 3400 | 56.42 | 1.04 | .6650 | 34 |
| 400 mm | 62.2 | 40 | 7.0 | .64 | 3000 | 56.52 | 1.76 | .7326 | 36 |
| 500 mm | 64.6 | 66 | 8.0 | 1.02 | 3550 | 60.2 | 2.0 | 1.1214 | 33 |
| 500 mm | 64.6 | 80 | 9.0 | 1.238 | 2965 | 52.98 | 1.57 | 1.429 | 38 |
| 500 mm | 79.9 | 98 | 10.0 | 1.226 | 4150 | 54.82 | 2.42 | 1.3 | 34 |
| 500 mm | 75.3 | 112 | 11.0 | 1.4864 | 3700 | 55.88 | 1.987 | 1.69 | 35 |

The following observations were made.

(1) Distribution is exceptionally good and the standard deviation (S.D. in above table) remains around or below 2.0.

(2) Throwing power is very good and superior to that of the prior art.

(3) Color is consistent and uniform from lot to lot regardless of the current density used. Furthermore, the color is identical with the color obtained with the high speed plating at 150° F. in Test 1.

(4) Solderability is exceptionally good and consistent.

(5) Cobalt in the deposit remains below 0.3% at all voltages.

(6) Little or no consideration need be given to current density since the bath does not burn within the parameters given above.

As a general rule, higher gold concentrations allow higher efficiency, current densities and plating rates. However, for economical reasons (lower inventory, lower drag out, etc.), gold contents are kept as low as possible, i.e. around 4.1 g/l and as low as 2 g/l.

In a further aspect of the invention, it has been found that part or all of the water soluble organophosphorous chelating agent can be replaced by malic acid, or a combination of malic acid and gluconic acid. In general, the quantities of such conductivity salts and inhibitors, i.e., of the organophosphorous chelating agents and/or replacing acids, is such as to provide a specific gravity of at least 13 to 14 Baume' in the bath. Where malic acid is used, typically from about 75 to 150 g/l of bath will be present; if in combination with an organophosphorous chelating agent, the total concentration of such agent and the malic acid will typically total about 150 g/l. From 10% to about 40% of the malic acid may be replaced by gluconic acid. Preferable pH's for these baths are in the range of 3.5 to 4.4, with a more preferred range being 3.7 to 4.0. Part or all of the acid levels indicated may, as is known in the art, be achieved by use of appropriate salts in the initial bath preparation, e.g., potassium gluconate.

The foregoing aspects of the invention are illustrated by the following:

EXAMPLE III

The Dequest 2010 compound of example 1 was replaced by malic acid. The following bath was prepared:

| | 1 liter |
|---|---|
| Malic acid | 150 grams |
| Formic acid | 60 ml |
| Potassium hydroxide | to pH 4.0 |
| Co (as EDTA complex) | 600 mg |
| Au—metal (as PGC) | 10 grams |

Slinkies (wires) were plated at 130° F:

| Current Density: | 20 ASF | 40 ASF | 60 ASF | 80 ASF | 120 ASF | 150 ASF |
|---|---|---|---|---|---|---|
| Efficiency: | 65.6 | 49.5 | 42 | 34 | 24 | 21.4 |
| Aspect: | bright | bright | bright | bright | bright | bright |

The cobalt content of the deposit plated @60 ASF was 0.193%.

Slinkies were plated at 150° F.:

| Current Density: | 20 ASF | 40 ASF | 60 ASF | 80 ASF | 120 ASF | 150 ASF |
|---|---|---|---|---|---|---|
| Efficiency: | 68.3 | 59.5 | 47.5 | 40.3 | 28.2 | 25.1 |
| Aspect: | bright | bright | bright | bright | bright | bright |

The cobalt content of the deposit plated @60 ASF was 0.149%.

The above bath was found to be eminently suitable for high speed plating applications and has been found to be capable of slightly higher current densities than the baths of the prior Examples.

EXAMPLE IV

Another bath, using a higher concentration of Dequest 2010 and a lesser amount of malic acid, was prepared. The bath formulation was:

| | 1 liter |
|---|---|
| Dequest 2010 | 75 ml |
| Malic acid | 75 grams |
| Formic acid | 60 ml |
| Potassium hydroxide | to pH 4.0 |
| Cobalt-metal (as EDTA complex) | 600 mg |
| Au—metal (as PGC) | 10 grams |

Slinkies were palted at 130° F.:

| Current Density: | 20 ASF | 40 ASF | 60 ASF | 80 ASF | 120 ASF |
|---|---|---|---|---|---|
| Efficiency: | 80.5 | 58.8 | 44.4 | 35.2 | 25 |
| Aspect: | dull | bright | bright | bright | bright |

Slinkies were palted at 150° F.:

| Current Density: | 20 ASF | 40 ASF | 60 ASF | 80 ASF | 120 ASF |
|---|---|---|---|---|---|
| Efficiency: | 85.2 | 70.8 | 56.6 | 44.1 | 33.3 |
| Aspect: | dull | semi-bright | semi-bright | semi-bright | dull |

The cobalt content of the deposit plated @60 ASF was 0.085%. The results at 150° F. are not as good as that at 130° F.

The cobalt content had to be increased to 1.5 gram per liter to give a good uniform deposit. Slinkies were plated at 130° F.:

| Current Density: | 20 ASF | 40 ASF | 60 ASF | 80 ASF | 120 ASF | 150 ASF |
|---|---|---|---|---|---|---|
| Efficiency: | 73.5 | 57 | 44 | 35 | 24.3 | 21.3 |
| Aspect: | semi-bright | bright | bright | bright | bright | bright |

The cobalt content of the deposit plated @ 60 ASF was 0.135%.

Slinkies were plated at 150° F.:

| Current Density: | 20 ASF | 40 ASF | 60 ASF | 80 ASF | 120 ASF | 150 ASF |
|---|---|---|---|---|---|---|
| Efficiency: | 79.2 | 68.2 | 52.2 | 40 | 30.7 | 21.3 |
| Aspect: | bright | bright | bright | bright | bright | semi-bright |

The cobalt content of the deposit plated @60 ASF was 0.104%.

EXAMPLE V

Another bath using oxalic acid was prepared. The bath formulation was:

| | 1 liter |
|---|---|
| Malic acid | 100 grams |
| Potassium gluconate | 50 grams |
| Oxalic acid | 20 grams |
| Formic acid | 60 ml |
| Potassium hydroxide | to pH 4.0 |
| Nickel metal (as NTA complex) | 600 mg |
| Au—metal (as PGC) | 10 grams |

Slinkies were plated at 130° F.:

| Current Density: | 20 ASF | 40 ASF | 60 ASF | 80 ASF | 120 ASF |
|---|---|---|---|---|---|
| Efficiency: | 52.8 | 43.4 | 35.6 | 31 | 25.2 |
| Aspect: | bright | bright | bright | bright | semi-bright |

The nickel content of the deposit plated @60 ASF was 0.141%.

Slinkies were plated at 150° F.:

| Current Density: | 20 ASF | 40 ASF | 60 ASF | 80 ASF | 120 ASF |
|---|---|---|---|---|---|

-continued

| | | | | | |
|---|---|---|---|---|---|
| Efficiency: | 62 | 53.2 | 46 | 40.8 | 30 |
| Aspect: | bright | bright | bright | bright | semi-bright |

The nickel content of the deposit plated @60 ASF was 0.151%.

The above results illustrate how the nickel content in the deposit can be brought to a lower and more acceptable level by the simple addition of oxalic acid.

It Will be apparent that the invention is capable of numerous variations without departing from the scope of the invention and without sacrificing its chief advantages.

What is claimed is:

1. A bath for producing deposits of gold by electrodeposition, comprising: an aqueous solution containing at least one soluble gold cyanide compound; formic acid in a concentration of at least 20 ml/l to about 150 ml/l of said bath solution, said formic acid concentrations being calculated on a 90% by weight grade of formic acid; a cobalt compound; sufficient alkali to bring the pH to within the range of 3.5 to 4.4; and as conductivity salts and inhibitors, malic acid or a combination thereof with gluconic acid or with a water soluble organophosphorous chelating agent, said conductivity chelating agent, said conductivity salts and inhibitors being present in at least sufficient quantity to provide a specific gravity of at least 13 Baume' in said bath.

2. A bath as set forth in claim 1, in which the conductivity salt and inhibitor is malic acid in concentrations of about 75 to 150 g/l.

3. A bath as set forth in claim 1, in which the conductivity salt and inhibitor is a combination of said organophosphorus chelating agent with malic acid.

4. A bath as set forth in claim 1, in which the conductivity salt and inhibitor is a combination of malic acid and gluconic acid.

5. A bath as set forth in claim 1 in which the formic acid concentration is above 40 ml to about 90 ml/liter.

6. A bath as set forth in claim 1 in which the formic acid concentration is above 40 ml to about 50 ml/liter.

7. A bath as set forth in claim 1 in which the chelating agent is a water soluble phosphonic acid.

8. A bath as set forth in claim 1 in which the chelating agent is selected from the group consisting of amino-tri (methylene phosphonic acid) and 1-hydroxyethylidene-1,1-diphosphonic acid.

9. A bath as set forth in claim 1 which also contains an alkali metal monophosphate.

10. A bath as set forth in which the phosphate is monopotassium phosphate.

11. A bath as set forth in claim 1 in which the gold cyanide is potassium gold cyanide.

12. A bath as set forth in claim 1 in which the gold metal content is within the range of about 2 g/liter to about 20 g/liter.

13. A bath as set forth in claim 12 in which the gold metal content is within the range of about 2 g/liter to about 4.1 g/liter.

* * * * *